United States Patent [19]

Gillette et al.

[11] 4,418,642

[45] Dec. 6, 1983

[54] BUILD CONTROL APPARATUS AND METHOD

[75] Inventors: Donald J. Gillette, Guilford; Bedrich Hajek, New Haven, both of Conn.

[73] Assignee: Electrostatic Equipment Corporation, New Haven, Conn.

[21] Appl. No.: 302,200

[22] Filed: Nov. 20, 1981

[51] Int. Cl.[3] ..... B05D 1/06

[52] U.S. Cl. ..... 118/624; 118/621; 427/32

[58] Field of Search ..... 427/27, 32, 33, 185; 118/623, 624, 625, 638, 621

[56] References Cited

U.S. PATENT DOCUMENTS

| | | | |
|---|---|---|---|
| 3,865,079 | 2/1975 | Kellams et al. | 118/629 |
| 3,919,437 | 11/1975 | Brown et al. | 427/32 |
| 4,053,661 | 10/1977 | Goodridge | 427/185 |
| 4,297,386 | 10/1981 | Gillette | 427/32 |
| 4,330,567 | 5/1982 | Gillette | 427/32 |

*Primary Examiner*—Norman Morgenstern
*Assistant Examiner*—Richard Bueker

[57] ABSTRACT

Build control means is provided by which the characteristics of a cloud of electrostatically charged particles can readily be altered, so as to produce an optimal deposit upon any of a variety of workpieces. The means described offers a high degree of flexibility of application for the apparatus in which it is employed, and is particularly adapted for use in coating electrical conductors of rectangular cross section.

15 Claims, 5 Drawing Figures

FIG.3
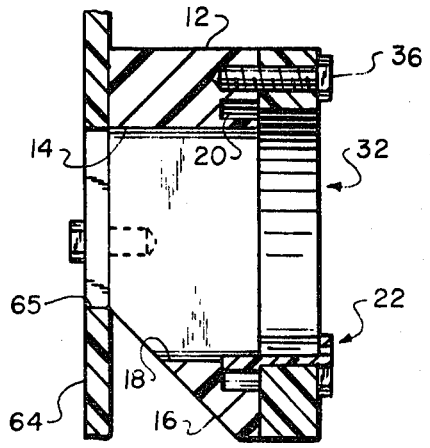
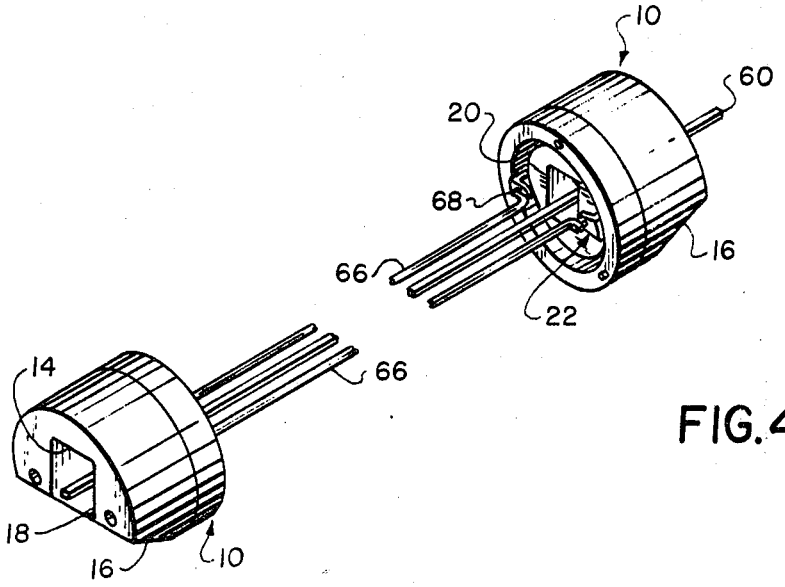
FIG.4
FIG.5
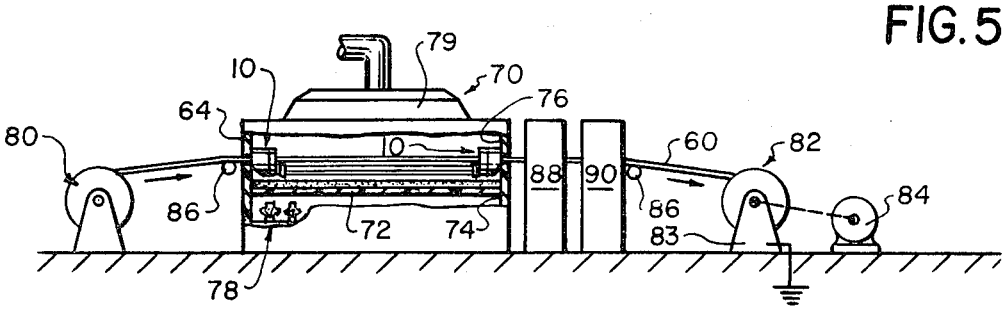

BUILD CONTROL APPARATUS AND METHOD

BACKGROUND OF THE INVENTION

Electrostatic fluidized bed coating is, of course, a conventional and widely used technique for depositing particulate materials upon a great diversity of workpieces. Typical of the apparatus used for that purpose are the devices disclosed in Knudsen U.S. Pat. No. 3,916,826 and in Karr U.S. Pat. No. 4,030,446, While electrostatic coating with such devices is highly efficient, effective and safe, fluidized bed coating in general is not without its limitations and difficulties.

A particularly difficult problem relates to the attainment of uniform deposits upon all surfaces of the articles being coated. Such problems are due in part to the effects of the workpiece configuration upon the nature of the coating produced. Thus, a non-uniform workpiece will tend to develop an irregular deposit, particularly when, for example, the article has sharp edges or elements of relatively small dimension. But even when the workpiece is of entirely uniform configuration and is free of edges (e.g., when it is a length of round wire), the proximity of other workpieces will usually have an effect. Thus, when a plurality of wires are coated simultaneously, stopping or removing one of them will usually significantly change the characteristics of the deposit produced upon the others. This is highly undesirable in an automated operation, such as is, as a practical matter, often necessary in the commercial production of insulated wire. But even when only one wire or conductor is involved, still a problem exists in producing the high degree of uniformity required for many applications, and this is particularly true when the conductor is of non-circular (e.g., rectangular) cross section.

In those instances in which coatings are produced upon articles moving horizontally (or substantially so) above or through a fluidized bed, the difficulty of producing uniformity is compounded by the fact that rarefaction occurs upwardly within the cloud. As a result, the upper surfaces of the articles are exposed to less powder than are the lower portions, and therefore the deposits developed thereon tend to be thinner. The generally upward movement of the particles of the cloud, under the influence of the gas passing upwardly through the porous support plate of the fluidized bed, also favors the development of heavier coatings on lower surfaces.

Attempts have been made to compensate for the foregoing characteristics of electrostatic fluidized bed coating, such as through the use of appropriate masking devices or baffles to block those surfaces which would otherwise tend to receive disproportionately large amounts of the powder; such apparatus is, for example, disclosed and claimed in Goodridge U.S. Pat. No. 3,828,729. In Westervelt et al U.S. Pat. No. 4,011,832, tubular build control means is disclosed for the purpose of controlling the uniformity of the thickness of deposits upon a workpiece. While those approaches have considerable merit, the equipment involved is of limited flexibility, and therefore not optimally suited to certain applications.

Many of the limitations inherent in prior art apparatus and methods have been alleviated or avoided by the inventions set forth in the following United States applications for Letters Patent, each of which is common assignment herewith: Ser. No. 14,656, filed in the name of Donald J. Gillette on Jan. 23, 1980 and now issued as U.S. Pat. No. 4,240,986, which application is entitled CONTROL GRID IN ELECTROSTATIC FLUIDIZED BUILD COATER; Ser. No. 218,521, filed on Dec. 23, 1980, also in the name of Donald J. Gillette, and now issued as U.S. Pat. No. 4,330,567, which application is entitled METHOD AND APPARATUS FOR ELECTROSTATIC COATING WITH CONTROLLED PARTICLE CLOUD; and Ser. No. 218,522, filed on Dec. 23, 1980 in the name of Walter G. Knudsen and now issued as U.S. Pat. No. 4,332,835, which application is entitled PLENUM MOUNTED GRID FOR ELECTROSTATIC FLUIDIZED BED. However, further improvement, especially in regard to uniformity of the deposit on workpieces of non-circular cross section, and in regard to the facility with which variations can be produced to accommodate different workpieces and to optimize the coating, are of course desirable.

Thus, it is a principal object of the present invention to provide novel build control means, apparatus, systems and methods, for electrostatic powder coating, by which workpieces, and especially wires and other electrical conductors of continuous length, can be coated with a high degree of uniformity, or controlled variation, in the thickness of the deposit.

It is a more specific object of the invention to provide novel build control means, and apparatus, systems and methods utilizing the same, which variations in the nature of the deposit produced can readily and conveniently be made, so as to achieve optimal results tailored to the characteristics of the workpiece being coated.

Another object is to provide the foregoing by means that are relatively simple and inexpensive to construct, and convenient and facile to utilize.

SUMMARY OF THE INVENTION

It has now been found that certain of the foregoing and related objects of the present invention are readily attained in adjustable build control means for electrostatic cloud coating apparatus, comprising a pair of end fixtures, at least one build control member, and means for securing the build control member to extend between the fixtures. Each of the fixtures has an opening therein to permit passage of a workpiece therethrough, and an engagement portion extending at least partially about the opening. The securing means secures the build control member with the engagement portions of the fixtures, so as to permit the control member extending therebetween to be disposed in any of a multiplicity of positions about the fixture openings. The fixtures are adapted for mounting at spaced locations in a coating apparatus, with the openings thereof in axial alignment to define a workpiece travel path therethrough. As a result, the build control member can be disposed in any of a multiplicity of angularly displaced positions about the axis of the travel path, and in alignment therewith. In preferred embodiments of the build control means, a plurality of build control members are included, with the securing means being adapted to dispose each of the build control members in any of a multiplicity of such angularly displaced positions. Most desirably, the securing means employed will be adapted not only to enable attainment of the angularly displaced positions, but also to dispose the build control member in any of a multiplicity of positions that are radially displaced from the axis.

Generally, the engagement portion of each of the end fixtures will be so configured that the locus of angularly displaced positions of the build control member will lie on an arc that is substantially concentric with the travel path axis. The fixtures may have a channel formed therein to comprise the engagement portion thereof, in which instance the securing means may include a tongue or insert portion that is received within the corresponding channel for sliding movement to substantially any location therealong; normally, a single, continuous channel will provide such an engagement portion. A separate support piece may be employed to provide the tongue portion of the securing means by which it is assembled to the fixture, with each such support piece having an attachment portion to engage and support the build control member between the fixtures. In especially desirable embodiments, each of the fixtures will have a plurality of such support pieces assembled therewith.

The build control member utilized will, in many instances, advantageously comprise an open grid structure fabricated substantially from an electrically conductive material. Alternatively (or in addition thereto), the control member may comprise a rod-like conductor, also fabricated from such a material.

Certain objects of the invention are attained in cloud coating apparatus comprising, in addition to the build control means hereinbefore described, a housing defining an electrostatic cloud coating chamber. In such embodiments, the fixtures of the build control means are mounted at spaced locations in the housing with the openings thereof in axial alignment, to define a workpiece travel path therethrough and through the housing, and the build control member is secured to the engagement portions of the fixtures, so as to extend therebetween. In the preferred embodiments of the apparatus, a porous plate will be mounted in the housing to define a coating chamber thereabove and a plenum therebelow, thereby providing an electrostatic fluidized bed unit.

Additional objects of the invention are attained in an electrostatic cloud coating system, comprised of means for conveying a workpiece along the travel path through the above-described apparatus. The conveying means will, in most instances, be adapted to pass a continuous-length workpiece therethrough.

Yet other objects of the invention are attained in the practice of a method for depositing a particulate material upon a workpiece including, as an initial step, forming a cloud of electrostatically charged particles. The characteristics of the cloud are controlled by a pair of electrically conducting grids that are disposed within the cloud, one on each side of a workpiece travel path, which grids are maintained at a potential different from that of the charged particles. A workpiece, which is also maintained at a potential different from that of the charged particles, is passed through the cloud along the defined travel path, which is out of contact with the grids and preferably thereabove. As a result, the workpiece may acquire upon all of its exposed surfaces a deposit of charged particles that is of controlled thickness.

In preferred embodiments of the method, the workpiece will be a continuous-length conductor, most desirably of rectangular cross-sectional configuration. In the latter instance, most effective operation will generally result with the grids disposed so that their longitudinal axes are parallel to the axis of the travel path, and equidistantly spaced therefrom as well as from one another. In many cases, it will be most advantageous to maintain both the grids and also the workpiece at ground potential.

BRIEF DESCRIPTION OF THE DRAWINGS

FIG. 3 is a vertical sectional view through the fixture of FIG. 2, taken along line 3—3 thereof and showing the fixture mounted on a fragmentarily illustrated wall of the housing defining a cloud chamber of an electrostatic fluidized bed coating unit;

FIG. 4 is a perspective view of a second embodiment of the assembly of the invention, in which one of a pair of rod-like conductors is disposed along each side of an electrical conductor passing therethrough; and FIG. 5 is a diagrammatical view of a system embodying the present invention, with the housing of the fluidized bed unit thereof partially broken away to show its internal construction and the mounting of the build control assembly therewithin.

DETAILED DECRIPTION OF THE ILLUSTRATED EMBODIMENTS

Figure 1:
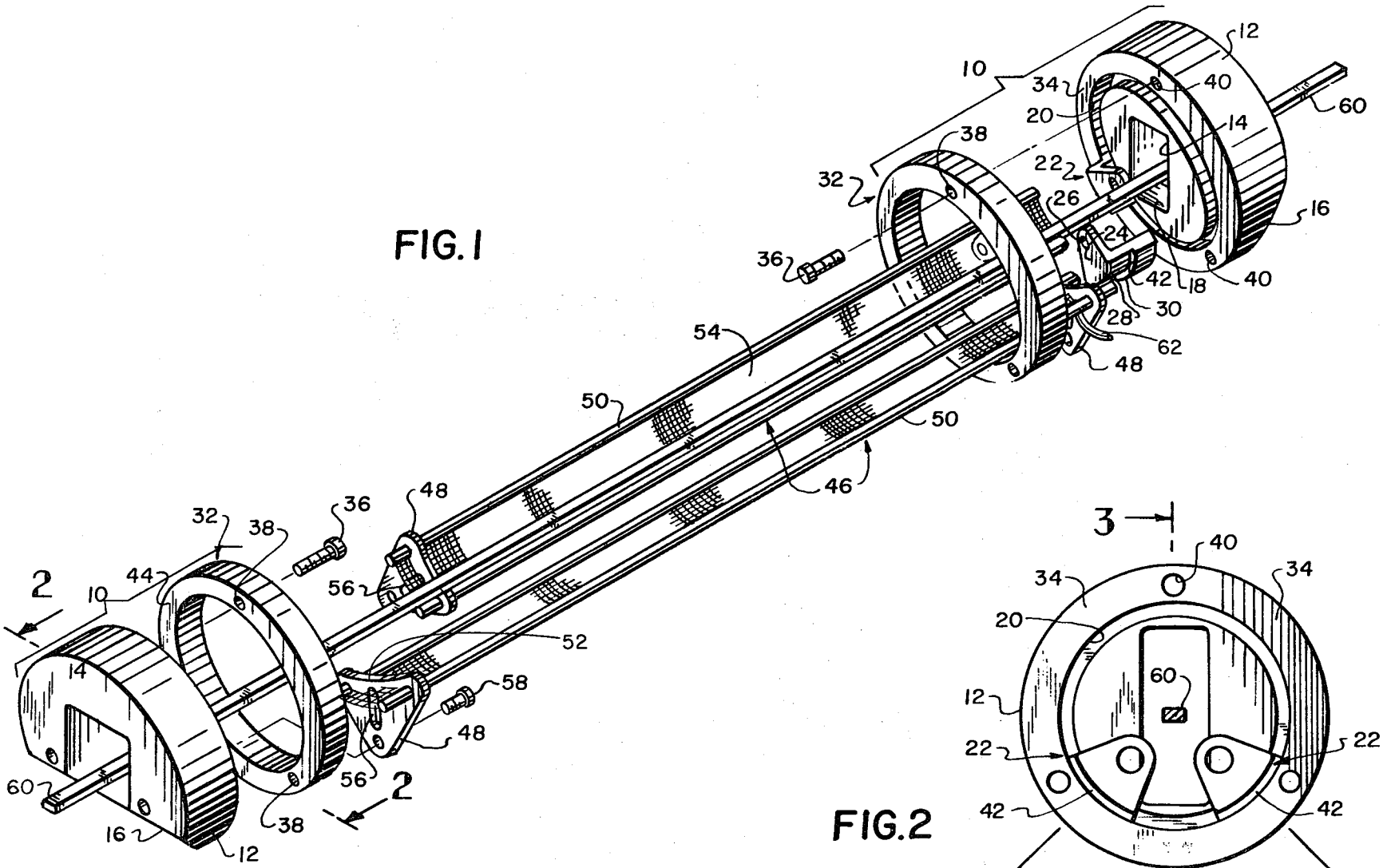
FIG. 1 is an exploded perspective view of a build control assembly embodying the present invention, shown with a single continuous-length conductor passing therethrough.
Figure 2:
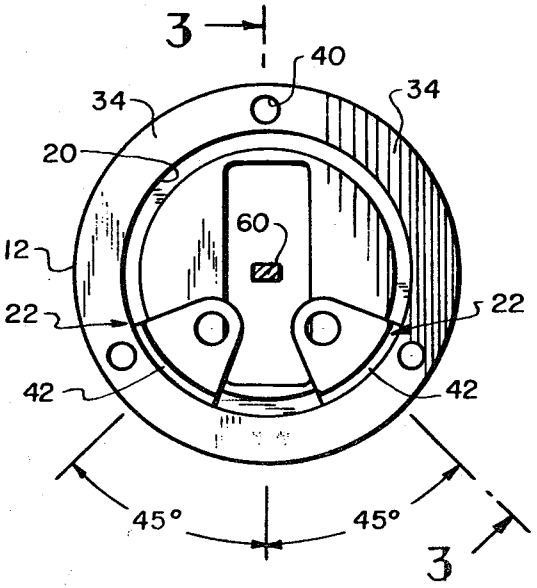
FIG. 2 is an elevational view of the left end fixture of the assembly of FIG. 1, drawn to a somewhat enlarged scale.

Turning now to FIGS. 1 through 3 of the appended drawings, therein illustrated is a build control assembly embodying the present invention, including a pair of end fixtures, each generally designated by the numeral 10. The fixtures 10 consist of a circular housing 12 having a generally rectangular passageway 14 therethrough. The lower rear edge of the housing 12 is bevelled at 16, thereby reducing the area of the horizontal surface 18 defining the floor of the passageway 14, and in turn minimizing the tendency for powder to build-up therewithin, which could otherwise ultimately come into direct contact with the workpiece. The front face of the housing 12 is formed with an annular channel or groove 20, which extends thereabout and is substantially concentric with the center-line axis of the passageway 14.

Seated within the channel 20 are two angle support pieces, each generally designated by the numeral 22. Each support piece 22 consists of a generally sectorial flange portion 24 having a tapped aperture 26 formed through its free end, and connected through a curved sidewall 28 to an arcuate lip or tongue portion 30. As can be seen, the tongue portions 30 of the support pieces 22 are slidably received within the channel 20, and may therefore be readily positioned at any location therealong.

A retaining ring or collar, generally designated by the numeral 32, is secured against the circumferential edge face 34 of the housing 12 by bolts 36, which pass through holes 38 in the ring 32 and are tightened into threaded bores 40. As will be noted, the ring 32 is wider (i.e., has a smaller inside diameter) than the circumferential face 34, causing it to extend over the arcuate shoulder 42 of the tongue portions 30 of each of the angle supports 32. The outer surfaces of the shoulders 42 normally extend very slightly beyond the face 34 of the housing 12, so that engagement of the clamping ring 32 thereupon will cause its inner surface 44 to bear upon the shoulders 42, thereby securing the pieces 22 in the positions selected.

A pair of grid structures, each generally designated by the numeral 46, are provided to control the nature of the particle cloud generated, and hence the characteristics of the build. The grid structures 46 are virtually identical, each consisting of a pair of axially or longitudinally spaced, generally triangular end places 48, between which are secured a pair of transversely spaced, generally parallel tubes 50. The tubes 50 cooperate with the lower arcuate edge 52 of the triangular plates 48 to support a mesh-like grid or screen 54, which is secured thereto by appropriate means, such as soldering. As will be noted, each of the plates 48 has a slot 56 formed therein along an axis which bisects the plate between the points of attachment of the tubes 50, and a bolt 58 is inserted therethrough and engaged within the tapped aperture 26 in the associated angle support piece 22. In this manner, the grid structures 46 are supported between the end fixtures 10 for radial as well as angular adjustment with respect to the travel path of the conductor 60.

More particularly, although the two grid structures 46 are shown with their longitudinal axes (which are parallel to the travel path of the wire 60) lying in planes that are angled about 45 degrees to either side of the vertical plane of the wire travel path (as best seen in FIG. 2), those positions can readily be altered, if so desired. This is accomplished by merely loosening the bolts 36 which hold the ring clamp 32 in position on the housing 12, thereby relieving the force upon the angle support pieces 22 and permitting them to be relocated to any selected position within the channel 20. By loosening the bolts 58, the radial positions of the grid structures 46 may also be altered by moving them inwardly or outwardly with respect to the wire 60, to any point along the length of the slots 56. The structures 46 may also be pivoted about the bolts 36, to provide yet further latitude for control of the nature of the particle cloud.

It should be noted that the above described 45-degree angular positioning of the grid structures 46 is taken to be optimal to achieve a uniform build upon the conductor 60, due to its rectangular cross section. Disposing the grid structures 46 in generally confronting relationship proximate to the sharp edges of the conductor 60 will have the effect of reducing the thickness of powder build that would otherwise tend to develop therealong, by counteracting or compensating for the relatively high charge concentrations that are inherently induced in such portions. Typically, the screen 54 will be spaced about $\frac{1}{8}$- to $\frac{3}{4}$-inch from the bottom of the workpiece, with the shielding effect decreasing as the separation is increased. Generally, both the conductor 60 and also the grid structures 46 will be maintained at ground potential, although (as will be discussed below) other electrical effects may be utilized; in any event, grounding of the grids can readily be achieved through the cables (such as at 62) attached to end plates 48.

Although only suggested in FIG. 3, it will be appreciated that the end fixtures 10 of the assembly are both secured to supporting structure (e.g., by bolting to the wall 64) of the coating unit in which the device is employed, which structure will, of course, also have an appropriate aperture 65 therein, to permit passage of the workpiece through the apparatus. The mounted relationships are more clearly shown in FIG. 5, which will be discussed in some detail hereinafter.

Turning first, however, to FIG. 4 of the drawings, therein illustrated is a second embodiment of the invention, wherein lengths of rod-like conductors 66 are secured by appropriate lugs 68 to the support pieces 22, in place of the grid structures 46. In all other respects, the build assembly of this Figure is virtually the same as that of the preceeding Figures, and so need not be discussed in detail. As will be noted, however, in this instance the build control members (i.e. the rod-like conductors 66) are disposed in horizontal alignment with, and to either side of, the workpiece 60, rather than at spaced locations therebelow. The purpose for utilizing such rods is to simulate wires adjacent to conductor 60, so as to thereby regulate build formation, and such a coplanar arrangement of the workpiece 60 and the rods 66 will often be found to be optimal for that purpose. Although only a single wire 60 is shown, the desirability of using the rod members 66 will generally be greatest when three or more wires are being coated and a single build control assembly is being employed. This is because the effect of changes in workpiece presence is most pronounced when it is the outermost of several wires that is stopped or removed, the members 66 effectively providing permanent outer conductors and thereby minimizing the effect upon the adjacent workpieces during ongoing operation.

From the description provided thus far, it will be appreciated that the present assembly affords an extensive range of variation in both the nature and the situation of build control members utilized, thereby offering maximum control over the quality and characteristics of the deposit produced. More particularly, it has been seen that grid structures and rod-like conductors can be employed, and obviously other members could be substituted, such as, for example, solid baffles or barriers. Also, it will be evident to those skilled in the art that combinations of different members can be used, and that the number thereof may vary. It follows that, although a number of supporting pieces appropriate to install two build control members has been shown, obviously only two such pieces (one on each fixture) would be necessary if the device were to employ only one control member; conversely, additional support pieces would be provided in the end fixtures if additional build control members were to be used. Perhaps it should also be pointed out that, while separate supporting pieces have been described and are believed to be the more satisfactory arrangement, the ends of the control members may themselves be configured for direct mounting in the fixtures (e.g., by integrally forming tongue portions thereon for insertion into the grooves of the end fixtures), thus obviating the use of angle support pieces of the sort illustrated.

The electrical effects employed to control the characteristics of the cloud may, of course, also be varied, and the practical possibilities are discussed in considerable detail in the above-identified applications of Gillette and of Knudsen. Thus, while the build control member may (as described above) advantageously be maintained at ground potential, certain avantages can also be realized by impressing upon the grids either a positive or a negative voltage, alternating, or constant or pulsating direct, current, and/or signals at frequencies that can be selected to produce specific effects. In such instances, the ground cable 62 (shown in FIG. 1) could be grounded through a variable resistance, connected to a suitable power supply, signal generator, or the like.

Although the end fixture 10 shown in the foregoing Figures is highly advantageous, those skilled in the art will appreciate that variations, of even a fairly basic nature, can be made without departing from the concepts of the invention. The structure illustrated is relatively simple and facile to produce, and offers the advantage of ready removability and insertion of the support pieces utilized. However, it may be advantageous in some instances to employ a housing that presents less surface area, to minimize as much as possible the accumulation of powder on internal surfaces of the coating unit, since such accumulations tend to produce clumps or agglomerates of the powder, which may fall upon and thereby mar the deposit and, in some instances, render the product unacceptable. By way of example and not of limitation, an alternative construction for the end fixtures may employ a rounded rail that is shaped to locate the build control members as desired, e.g., in a circular configuration; the rounded cross section will present a minimum amount of horizontal surface area upon which the powder can accumulate. Finally, to avoid the possibility of powder falling upon the conductor as it passes through the housings 10, the passages 14 may be extended upwardly, to provide an open channel rather than an aperture. While this may hamper somewhat the ease with which a build control member can be positioned directly over the workpiece (should it be desired to do so), this will not, in most instances, represent a serious disadvantage.

Turning now to FIG. 5, diagrammatically shown therein is an electrostatic fluidized bed coating unit, generally designated by the numeral 70, divided by a porous plate 72 into a plenum 74 therebelow and a coating chamber 76 thereabove. As is conventional (see, for example, the above-identified Knudsen patent), an electrode assembly, generally designated by the numeral 78, is mounted in the plenum 74 to effect ionization of the charging and fluidizing air, and a powder recovery and recirculation system (not shown) communicates through the hood structure 79 with the coating chamber 76. Build control members (e.g., grid structures 46) are supported by the end fixtures 10, which are in turn bolted to the walls 64. As can be seen, the structures 46 span the chamber longitudinally to affect the build through the entire exposed length of the workpiece; however, this need not necessarily be true, and shorter members may be desirable in some cases.

The system also includes wire supply and takeup rolls, generally designated respectively by the numerals 80 and 82, and it will be apparent that the strand of wire 60 is played-off from the supply roll 80 and is wound upon the takeup roll 82 (the stand 83 for which is shown here to be grounded, to effect grounding of the wire) after passing through the fluidization chamber 76 of the coater. Drive means 84 for the takeup roll 82, and appropriate support means for the wire (such as the idler rolls 86), are also provided, as are means 88 for heating the wire and/or the deposit (to effect fusion of the latter) and means 90 for cooling (and thus hardening) the coating subsequent to fusion. Although not illustrated, powder feed and other conventional means will be included in a typical system; FIG. 5 is intended only to be illustrative of a wire coating system of the sort for which the build control means disclosed herein is particularly well adapted, and should not be regarded as limiting. For example, electrostatic powder guns may be used to generate the cloud of particles, if so desired, although fluidized beds will be preferred in most instances.

While particular emphasis has been placed upon the use of the several embodiments of the invention for the coating of articles of continuous length, it will be understood that the concepts hereof are not so limited, and may be applied with comparable advantage to the coating of a variety of discrete workpieces. Moreover, it should be understood that coating of a variety of continuous length articles is contemplated, including round and rectangular wire or other electrical conductors, metal strip, screen, and the like, with appropriate modifications (in terms of size, number, positions and nature of the parts) being made to accomodate and most effectively coat the particular workpiece involved. Also (and as suggested above), while only a single continuous length of conductor has been depicted, certainly the apparatus of the invention can be employed in connection with the simultaneous coating of multiple wires (normally running mutually parallel) or other workpieces, although in some instances it may be more advantageous to employ a separate build control assembly for each conductor, in view of the added measure of control that such a practice would afford.

As indicated previously, the build control members themselves will normally be constructed of an electrically conductive material, to ensure that the desired effect is most uniformly and efficiently produced. The supporting structure will, on the other hand, generally be fabricated from a high dielectric material, to provide the necessary safety and operating characteristics, as is well known.

Thus, it can be seen that the present invention provides novel build control means, apparatus, systems and methods for electrostatic powder coating, by which workpieces, and especially wires and other conductors of continuous length, can be coated with a high degree of uniformity or controlled variations in the thickness of the deposit. Modification of the characteristics of the particle cloud can readily and conveniently be produced, so as to achieve optimal deposits that are tailored to the peculiarities of the workpiece being coated. These results are achieved by means that are relatively simple and inexpensive to construct, as well as being convenient and facile to utilize.

Having thus described the invention, what is claimed is:

1. Adjustable build control means for electrostatic cloud coating apparatus, comprising a pair of fixtures, each fixture having an opening therein to permit passage of a workpiece therethrough and an engagement portion extending at least partially about said opening of said fixture; at least one build control member; and means for securing said build control member to said engagement portions of said fixtures to extend therebetween, said engagement portions being so configured as to permit variation of the angular relationship of all parts of said build control member to the workpiece by movement of said build control members angularly as a unit to any of a multiplicity of positions about said openings thereof, said fixtures being adapted for mounting at spaced locations in the coating apparatus, with said openings thereof in axial alignment to define a workpiece travel path therethrough, whereby said build control member can be disposed in any of a multiplicity of angularly displaced positions about the axis of said travel path.

2. The build control means of claim 1 wherein a plurality of said build control members are included, and wherein said securing means is adapted to dispose each of said build control members in any of a multiplicity of such angularly displaced positions.

3. The build control means of claim 1 wherein said securing means is additionally adapted to dispose said build control member in any of a multiplicity of positions radially displaced from said axis.

4. The build control means of claim 1 wherein said engagement portion is so configured that the locus of said angularly displaced positions lies on an arc that is substantially concentric with said axis.

5. The build control means of claim 1 wherein each of said fixtures has a channel formed therein comprising said engagement portion thereof, and wherein said securing means includes an insert portion received within each of said channels for sliding movement to substantially any location therealong.

6. The build control means of claim 5 wherein said engagement portion comprises a single, continuous channel.

7. The build control means of claim 5 wherein said securing means includes a separate support piece assembled with each of said fixtures and providing said insert portions, each of said pieces having an attachment portion to engage and support said build control member therebetween.

8. The build control means of claim 7 wherein each of said end fixtures has a plurality of said support pieces slidably assembled therewith.

9. The build control means of claim 1 wherein said build control member comprises an elongated grid structure fabricated substantially from an electrically conductive material.

10. The build control means of claim 9 wherein the inner surface of said grid structure, adapted for positioning in confronting relationship to said travel path, is of arcuate cross section.

11. The build control means of claim 1 wherein said build control member comprises a rod-like conductor fabricated substantially from an electrically conductive material.

12. Electrostatic cloud coating apparatus, comprising: a housing defining a cloud coating chamber; and said build control means of claim 1, said fixtures thereof being mounted at spaced locations in said housing with said openings thereof in axial alignment to define a workpiece travel path therethrough and through said housing, and said build control member being secured to said engagement portions of said fixtures and extending therebetween.

13. The apparatus of claim 12 wherein said housing has a porous plate mounted generally horizontally therein to define said coating chamber thereabove and a plenum therebelow, to provide an electrostatic fluidized bed unit.

14. An electrostatic cloud coating system, comprising: said apparatus of claim 12; and means for conveying a workpiece along said travel path defined therethrough.

15. The system of claim 14 wherein said conveying means is adapted to pass a continuous-length workpiece through said apparatus.

* * * * *